US009959793B2

(12) United States Patent
Chen et al.

(10) Patent No.: US 9,959,793 B2
(45) Date of Patent: May 1, 2018

(54) DISPLAY SYSTEM

(71) Applicant: BOE Technology Group Co., Ltd., Beijing (CN)

(72) Inventors: Yanshun Chen, Beijing (CN); Youmei Dong, Beijing (CN); Wenbo Li, Beijing (CN); Qingjiang Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days. days.

(21) Appl. No.: 14/540,499

(22) Filed: Nov. 13, 2014

(65) Prior Publication Data

US 2015/0379911 A1 Dec. 31, 2015

(30) Foreign Application Priority Data

Jun. 26, 2014 (CN) ..... 2014 1 0300235

(51) Int. Cl.

| | |
|---|---|
| ***G09G 5/12*** | (2006.01) |
| ***G09G 3/00*** | (2006.01) |
| ***G07F 19/00*** | (2006.01) |

(52) U.S. Cl.

CPC ..... *G09G 3/001* (2013.01); *G07F 19/201* (2013.01); *G07F 19/205* (2013.01); *G09G 2340/12* (2013.01); *G09G 2358/00* (2013.01)

(58) Field of Classification Search

CPC ..... G07F 19/201; G07F 19/205; G09G 2340/12; G09G 2358/00; G09G 3/001

(Continued)

(56) References Cited

U.S. PATENT DOCUMENTS 6,597,328 B1 * 7/2003 Stern ..... G09G 5/00 345/9
6,959,389 B1 * 10/2005 Dunn ..... H04M 3/382 340/5.2

(Continued)

FOREIGN PATENT DOCUMENTS

CN 101681585 A 3/2010
CN 102271274 A 12/2011

(Continued)

OTHER PUBLICATIONS

First Office Action, including Search Report, for Chinese Patent Application No. 201410300235.2, dated Dec. 24, 2015, 15 pages.

(Continued)

*Primary Examiner* — Lun-Yi Lao
*Assistant Examiner* — Kelly Hegarty
(74) *Attorney, Agent, or Firm* — Westman, Champlin & Koehler, P.A.

(57) ABSTRACT

An embodiment of the present disclosure provides a display system which is related to the field of display technology. The display system enables a display device to be switched between a normal display mode and an anti-peeping display mode. This display system comprises a display device which comprises a display panel for displaying content. The display system further comprises: a display mode switch configured to switch between display modes of the display device, the display modes comprising a normal display mode and an anti-peeping display mode; a signal processor configured to provide signals to the display device, wherein the signal processor provide a normal signal to the display device when the display device is in the normal display mode, and the signal processor provide the normal signal and an interference signal alternately to the display device when the display device is in the anti-peeping display mode; and a shutter eyeglass configured to be enabled when the (Continued)

display device is in the anti-peeping display mode, wherein the shutter eyeglass is in an open state when the signal processor provides the normal signal, and the shutter eyeglass is in a closed state when the signal processor provides the interference signal.

19 Claims, 7 Drawing Sheets

(58) Field of Classification Search
USPC ..... 345/108
See application file for complete search history.

(56) References Cited

U.S. PATENT DOCUMENTS 7,191,338 B2 * 3/2007 Stern ..... G06F 21/84 345/4
7,978,929 B2 * 7/2011 Kim ..... G06F 21/84 380/207
8,848,044 B2 * 9/2014 Miyasaka ..... G09G 5/00 345/102
8,867,780 B2 * 10/2014 Hodge ..... G06F 21/84 382/100
9,465,250 B2 * 10/2016 Wu ..... G06F 21/84
2003/0128218 A1 * 7/2003 Struyk ..... G09G 5/02 345/581
2009/0059103 A1 * 3/2009 Azor ..... G02F 1/1347 349/8
2009/0262127 A1 * 10/2009 Miyasaka ..... G09G 3/001 345/589
2010/0182500 A1 * 7/2010 Ishii ..... G09G 5/395 348/441
2010/0271396 A1 * 10/2010 Nemeth ..... G06F 21/84 345/641
2010/0297946 A1 * 11/2010 Alameh ..... H04M 1/7253 455/41.3
2010/0299390 A1 * 11/2010 Alameh ..... G06F 3/017 709/204
2011/0090233 A1 * 4/2011 Shahraray ..... G02B 27/2264 345/520
2013/0076785 A1 * 3/2013 Chen ..... G09G 3/001 345/629
2013/0103943 A1 * 4/2013 Hirsch ..... G09C 5/00 713/168
2015/0070742 A1 * 3/2015 Sorek ..... G02B 5/20 359/238

FOREIGN PATENT DOCUMENTS

CN 102467619 A 5/2012
CN 102523460 A 6/2012
CN 102542993 A 7/2012
CN 103676295 A 3/2014

OTHER PUBLICATIONS

Second Office Action for Chinese Patent Application No. 201410300235.2, dated May 3, 2016, 16 pages.
Rejection Decision for Chinese Patent Application No. 201410300235.2, dated Oct. 10, 2016, 15 pages.
Reexamination Notification for Chinese Patent Application No. 201410300235.2, dated Aug. 3, 2017, 17 pages.

* cited by examiner

DISPLAY SYSTEM

CROSS-REFERENCE TO RELATED APPLICATION(S)

This application claims priority to Chinese Application No. 201410300235.2, filed on Jun. 26, 2014, which is incorporated herein by reference in its entirety.

TECHNICAL FIELD

The present disclosure relates to the field of display technology, and in particular, to a display system which enables switching between a normal display mode and an anti-peeping display mode.

BACKGROUND

With development of the network technology, the number of persons who are shopping or performing an account transaction via the Internet is increasing. During the above operations, an operator may have to input personal information into a display device, such as, a computer, a mobile phone, an Automated Teller Machine (ATM), or a ticket machine, and thus the personal information may be divulged easily. Therefore, the anti-peeping feature of a display device is attracting more attention.

To be specific, a display device having an anti-peeping feature mainly comprises a display means and a pair of eyeglasses. A lower polarizer is disposed only on one side of an array substrate on the display means. The lenses of the eyeglasses are polarizers corresponding to the lower polarizer on the array substrate, and the operator wears the eyeglasses to perform respective operations. Since a non-operator does not wear the eyeglasses, he/she can only observe an empty image and the anti-peeping is thus achieved.

When using a display device actually, the present inventors find out that the display device with the above anti-peeping feature will stay in the anti-peeping display mode always and this brings a lot of troubles. For example, an operator cannot decide whether or not to enable the anti-peeping feature based on his/her own requirements. Alternatively, without wearing the eyeglasses, an operator cannot determine whether the display device malfunctions or not, and thus may perform some unnecessary operations.

SUMMARY

The technical problem to be solved by the present disclosure is how to provide a display system which enables switching between a normal display mode and an anti-peeping display mode.

In order to address the above technical problem, an embodiment of the present disclosure provides a display system which adopts a technical solution as follows:

A display system, comprising a display device which comprises a display panel for displaying content, the display system further comprising:

a display mode switch configured to switch between display modes of the display device, the display modes comprising a normal display mode and an anti-peeping display mode;

a signal processor configured to provide signals to the display device, wherein the signal processor provide a normal signal to the display device when the display device is in the normal display mode, and the signal processor provide the normal signal and an interference signal alternately to the display device when the display device is in the anti-peeping display mode; and a shutter eyeglass configured to be enabled when the display device is in the anti-peeping display mode, wherein the shutter eyeglass is in an open state when the signal processor provides the normal signal, and the shutter eyeglass is in a closed state when the signal processor provides the interference signal.

The image displayed by the display device when the signal processor provides the normal signal is a normal image, and the image displayed by the display device when the signal processor provides the interference signal is an interference image. When the display device is in the anti-peeping display mode, the normal signal and the interference signal which are provided alternately will result in a mixed image perceived by a person without the shutter eyeglass, the mixed image being formed by overlapping the interference image displayed for a period of time and the normal image displayed for a contiguous period of time.

Preferably, the period of time is time for a frame of image, the contiguous period of time is also time for a frame of image, and the mixed image is a monochromatic image.

Preferably, a black image is located between two contiguous monochromatic images.

Preferably, the period of time is time for a frame of image, the contiguous period of time is time for at least one frame of image, the mixed image is a garbled image, and the garbled image appears as mosaic or a chessboard.

Preferably, the period of time is time for a frame of image, and the contiguous period of time is time for at least two frames of image.

Preferably, the signal processor comprises an infrared transmission module, the shutter eyeglass comprises an infrared reception module, and the identity (ID) of the infrared transmission module corresponds to the ID of the infrared reception module in a one-to-one manner.

The infrared transmission module transmits an infrared signal which carries the ID information of the infrared transmission module. The infrared reception module receives the infrared signal, and confirms whether the ID information which is carried by the received infrared signal is the ID information of the infrared transmission module or not. If yes, then the infrared reception module responds with a feedback which carries the ID information of the infrared reception module. The infrared transmission module receives the feedback, and confirms whether the ID information which is carried by the feedback is the ID information of the infrared reception module or not. If yes, then the infrared transmission module and the infrared reception module are paired successfully.

Preferably, the single processor comprises a frequency synchronization unit configured to make the switching frequency of the normal signal and the frequency of the interference signal provided by the signal processor to be consistent with the switching frequency of the shutter eyeglasses.

Preferably, the shutter eyeglass comprises two pieces of lenses or one piece of lens.

Preferably, the display device further comprises a shutter eyeglass accommodation structure, and the shutter eyeglass is movably connected to the shutter eyeglass accommodation structure.

When the display device is switched to the anti-peeping display state, the shutter eyeglass is ejected from the shutter eyeglass accommodation structure in a direction from top to bottom, from bottom to top, from left to right, or from right to left.

Preferably, the shutter eyeglass is ejected from the shutter eyeglass accommodation structure in a direction from top to bottom.

Preferably, the display device further comprises a touch screen to receive user input.

Preferably, the display mode switch comprises a display mode switch button disposed on the display device.

Preferably, the display system further comprises an integrated circuit which comprises a data bus and an interface, a microprocessor control module, a display device control module, a display mode control module, and a shutter eyeglass control module which are interconnected via the data bus, wherein the interface is configured to connect the display system to another system or device;

wherein the microprocessor control module is configured to communicate with the display device control module via the data bus to enable the display system to achieve the display function;

wherein the display device control module is configured to control the display device;

wherein the display mode control module is configured to control the display mode switch; and wherein the shutter eyeglass control module is configured to control the movement of the shutter eyeglass.

Preferably, the display device is an Automated Teller Machine (ATM).

An embodiment of the present disclosure provides a display system comprising a display device, a signal processor, a shutter eyeglass, and a display mode switch. The display mode switch is configured to switch between modes of the display device to make the display device stay in a normal display mode or an anti-peeping display mode. When the display device is in the normal display mode, the signal processor provides a normal signal to the display device, and an operator is not required to wear the shutter eyeglass to observe a normal image. When the display device is in the anti-peeping display mode, the signal processor provides a normal signal and an interference signal alternately, and the shutter eyeglass is enabled. During the process of providing the normal signal by the signal processor, the shutter eyeglass is in an open state. During the process of providing the interference signal by the signal processor, the shutter eyeglass is in a closed state. In this way, only the operator who wears the shutter eyeglass may observe the normal image, and any person who does not wear the shutter eyeglass can only perceive a mixed image, which is formed by overlapping the normal image and the interference image, such as, a garbled image or a monochromatic image. Accordingly, the anti-peeping function is achieved. The display system is able to be switched between the normal display mode and the anti-peeping display mode. The operator may decide whether the anti-peeping is required or not based on his/her own requirements or the operator may determine whether the display device malfunctions or not with his/her own naked eyes, thereby unnecessary operations are prevented.

BRIEF DESCRIPTION OF THE DRAWINGS

In order to illustrate technical solutions of embodiments of the present disclosure or those in the prior art in a clearer manner, figures to be used in the descriptions of the embodiments will be introduced briefly. Obviously, the figures in the following descriptions are merely some embodiments of the present disclosure. For one skilled in the art, other figures may be derived from these figures without any inventive efforts.

REFERENCE NUMERALS

1—Display Device;
2—Display Mode Switch;
3—Signal Processor;
31—Infrared Transmission Module;
4—Shutter Eyeglass;
41—Infrared Reception Module;
5—Integrated Circuit;
51—Data Bus;
52—Interface;
53—Microprocessor Control Module;
54—Display Device Control Module;
55—Display Mode Control Module; and
56—Shutter Eyeglass Control Module.

DETAILED DESCRIPTION

A clear and complete description of the technical solutions according to embodiments of the present disclosure will be given below in conjunction with the figures of the embodiments of the present disclosure. Obviously, the described embodiments are partial embodiments of the present disclosure, rather than all embodiments. Based on the embodiments of the present disclosure, all other embodiments obtained by one ordinarily skilled in the art without any inventive efforts fall into the scope of the present disclosure.

According to an embodiment of the present disclosure, there is provided a display system. The display system 100 may achieve switching between a normal display mode and an anti-peeping display mode.

Figure 1:
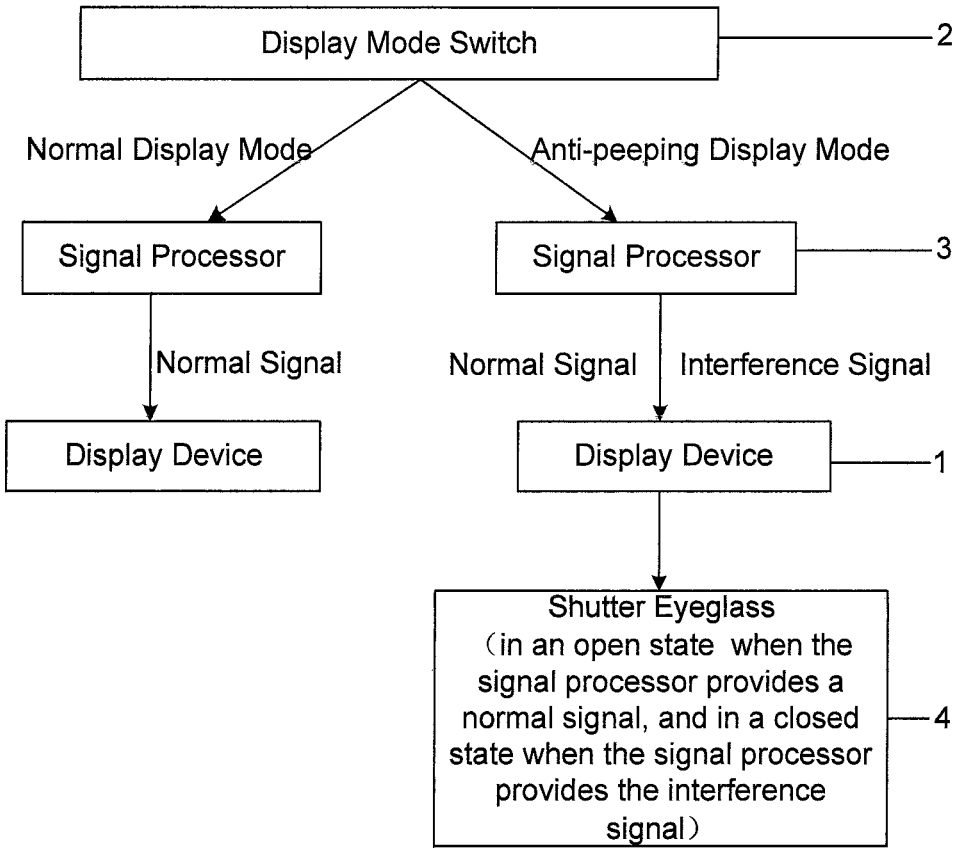
FIG. 1 is a schematic diagram showing a first kind of a display system according to an embodiment of the present disclosure.

To be specific, as shown in FIG. 1, the display system 100 comprises: a display device 1, a display mode switch 2, a signal processor 3, and a shutter eyeglass 4.

The display device 1 comprises a display panel for displaying content. According to the embodiment of the present disclosure, the display panel has an upper polarizer and a lower polarizer on both sides for showing the content normally, such that any person who does not wear the eyeglass may see the displayed content. As an example, the display device 1 may be any product or component that has a display function, such as, an LCD panel, an electronic paper, an organic LED panel, a mobile phone, a tablet, a TV, a display, a laptop computer, a digital photoframe, a navigator, or an ATM. Optionally, the display device in the embodiment of the present disclosure is an LCD panel. Further, a shutter eyeglass accommodation structure may be disposed on the display device 1 in the embodiment of the present disclosure, and the shutter eyeglass 4 may be movably connected to the shutter eyeglass accommodation structure, to facilitate accommodation and usage of the shutter eyeglass 4. As an example, the shutter eyeglass accommodation structure may be a groove. When the display device 1 is switched into the anti-peeping display mode, the shutter eyeglass 4 is enabled and ejected from the shutter eyeglass accommodation structure. The direction in which it is ejected may be from top to bottom, from bottom to top, from left to right, or from right to bottom. In a preferred embodiment of the present disclosure, it is ejected from top to bottom. Further, after the shutter eyeglass 4 is ejected, the operator may adjust the specific position of the shutter eyeglass 4 as required to facilitate the operator in watching.

Meanwhile, in order for the operator to operate the display device 1 more conveniently and quickly, the display device 1 may further comprise a touch screen for receiving user input. As an example, the touch screen may be a resistive touch screen, a capacitive touch screen, an infrared touch screen, a wave-based touch screen, or a ceramic voltage controlled touch screen, and the embodiments of the present disclosure are not limited thereto.

The display mode switch 2 is used for switching the display modes of the display device 1. The display modes comprise a normal display mode and an anti-peeping display mode. The display mode switch 2 switches such that the display device 1 is in a normal display mode or an anti-peeping display mode. In order for the operator to switch the display modes of the display device 1, in a preferred embodiment of the present disclosure, the display mode switch 2 comprises a display mode switch button disposed on the display device 1.

The signal processor 3 provides signals to the display device 1. When the display device 1 is in the normal display mode, the signal processor 3 provides a normal signal to the display device 1. When the display device 1 is in the anti-peeping display mode, the signal processor 3 provides the normal signal and an interference signal alternately to the display device 1. The interference signal may comprise one type of abnormal signal, or multiple types of abnormal signals. The image displayed by the display device when the signal processor 3 provides the normal signal is a normal image, and the image displayed by the display device when the signal processor 3 provides the interference signal is an interference image.

When the display device 1 is in the anti-peeping display mode, the shutter eyeglass 4 is enabled. During the process of providing the normal signal by the signal processor 3, the shutter eyeglass 4 is in an open state. During the process of providing the interference signal by the signal processor 3, the shutter eyeglass 4 is in a closed state. The lens of the shutter eyeglass 4 may control whether light may pass through or not. In this way, the operator may or may not see the displayed image. In an embodiment of the present disclosure, preferably, during the process of providing the normal signal by the signal processor 3, both of the left and right eyes of the shutter eyeglass 4 are in the open state, and thereby both eyes of the operator may see the normal image. During the process of providing the interference signal by the signal processor 3, both of the left and right eyes of the shutter eyeglass 4 are in the closed state, and thereby both eyes of the operator may not see the interference image. At this time, the states for the left and right eyes of the shutter eyeglass are same. Accordingly, the shutter eyeglass 4 may comprise two pieces of lenses or one piece of lens. Further, each lens covers at least one eye to guarantee the normal viewing of the operator. The size and shape of lenses are not limited in the embodiments of the present disclosure.

As shown in FIG. 1, during the operation of the display system with the above configuration, when the display mode switch 2 causes the display device 1 to be in the normal display mode, the signal processor 3 provides the normal signal only, and the display device 1 display the normal image only. In the prior art, a display device with the anti-peeping feature only comprises a lower polarizer disposed on one side of the display panel close to the backlight modules, and the upper polarizer is provided as an lens of an eyeglass. An operator can only see an empty image without the eyeglass. However, in an embodiment of the present disclosure, the display device 1 comprises a normal display panel, i.e., a display panel that may display content normally. An upper polarizer and a lower polarizer are disposed on both sides of the display panel. When the display device 1 is in the normal display mode, the operator may see the normal image without wearing the shutter eyeglass to facilitate the operator in deciding whether the anti-peeping display is required or not or facilitate the operator in finding out whether the display device 1 malfunctions or not, thereby avoiding any unnecessary operations. When the display mode switch 2 causes the display device 1 to be in the anti-peeping display mode, the signal processor 3 provides the normal signal and the interference signal alternately, and the shutter eyeglass is enabled. During the process of providing the normal signal by the signal processor 3, the display device 1 displays the normal image and the shutter eyeglass 4 is in the open state, such that the operator may see the normal image. During the process of providing the interference signal by the signal processor 3, the display device 1 displays the interference image and the shutter eyeglass 4 is in the closed state, such that the operator cannot see the interference image. When the display device 1 is in the anti-peeping display mode, the operator has to wear the shutter eyeglass 4 to see the normal image only without seeing the interference image, and any person who does not wear the shutter eyeglass 4 may see the normal image and the interference image. According to an embodiment of the present disclosure, the normal image and the interference image thus provided utilize the persistence of vision of human eyes, such that the person who does not wear the shutter eyeglass 4 perceives a garbled image or a monochromatic image which is formed by overlapping the normal image and the interference image, whereas the person who wears the shutter eyeglass 4 perceives an image which is formed by overlapping the normal image and a black image. For example, the time for persistence of vision of human eyes is about 1/24 second, and therefore the duration for the normal image and for the interference image may be 1/24 second. For example, the switching rate for the normal image and the interference image may be 24 frames per second. According to the present application, the interference image may be any image as long as it may interfere with the display of the normal image such that the normal image is blurred or even unrecognizable. In this way, the person who does not wear the eyeglass cannot see the displayed content clearly or even cannot recognize the displayed content completely. For example, the interference image may be a cluttered image, and the overlapping of the interference image and the normal image causes the content displayed in the normal image unrecognizable. For another example, the interference image may even be some other image than a black image, and the overlapping of the interference image and the normal image causes the content displayed in the normal image to be blurred.

An embodiment of the present disclosure provides a display system comprising a display device, a signal processor, a shutter eyeglass, and a display mode switch. The display mode switch may cause the display device to be in the normal display mode or in the anti-peeping display mode. When the display device is in the normal display mode, the signal processor provides the normal signal to the display device, and the operator may see the normal image without wearing the shutter eyeglass. When the display device is in the anti-peeping display mode, the signal processor provides the normal signal and the interference signal alternately to the display device, and the shutter eyeglass is enabled. During the process of providing the normal signal by the signal processor, the shutter eyeglass is in the open state. During the process of providing the interference signal by the signal processor, the shutter eyeglass is in the closed state. In this way, only the operator who wears the shutter eyeglass may see the normal image, and the person who does not wear the shutter eyeglass can only perceive a garbled image or a monochromatic image, thereby the anti-peeping function is achieved. In this way, the display system may be switched between the normal display mode and the anti-peeping display mode, such that the operator may decide whether the anti-peeping is required or not based on his/her own requirements or the operator may determine whether the display device malfunctions or not with his/her own naked eyes without causing any unnecessary operations.

To be specific, when the display device 1 is in the anti-peeping display mode, the signal processor 3 provides the normal signal and the interference signal alternately. In other words, the signal processor 3 provides the normal signal for a period of time, and the display device 1 display the normal image; and the signal processor 3 provides the interference signal for a contiguous period of time, and the display device 1 display the interference image. Because of the persistence of vision of human eyes, the person who does not wear the shutter eyeglass 4 perceives a mixed image which is formed by overlapping the normal image displayed for a period of time and the interference image displayed for a contiguous period of time. It should be noted that the signal processor 3 provides the normal signal and the interference signal according to a certain sequence. The display of the normal image and the interference image thus follows a certain sequence. The above overlapping of the normal image and the interference image does not mean that both of the normal image and the interference image are displayed simultaneously, but means that only the mixed image formed by overlapping the normal image and the interference image can be perceived due to the human eyes' discernibility. Therefore, the provision of the above normal image and the interference image should comply with the persistence of vision of human eyes. For example, if the normal image and the interference image last for one second, respectively, then the person who does not wear the shutter eyeglass 4 will see a flickering normal image and interference image, and may recognize the normal image. In this case, the effect of anti-peeping cannot be achieved. Therefore, in order to achieve the effect of anti-peeping, the switching rate of the normal image and the interference image may be, for example, 24 frames per second, 48 frames per second, or even higher.

Depending on variants of interference signals, the mixed image formed by overlapping the normal image displayed for a period of time and the interference image displayed for a contiguous period of time may be a garbled image or a monochromatic image, as long as the person who does not wear the shutter eyeglass cannot recognize the normal image. The present disclosure is not limited thereto.

Figure 2:
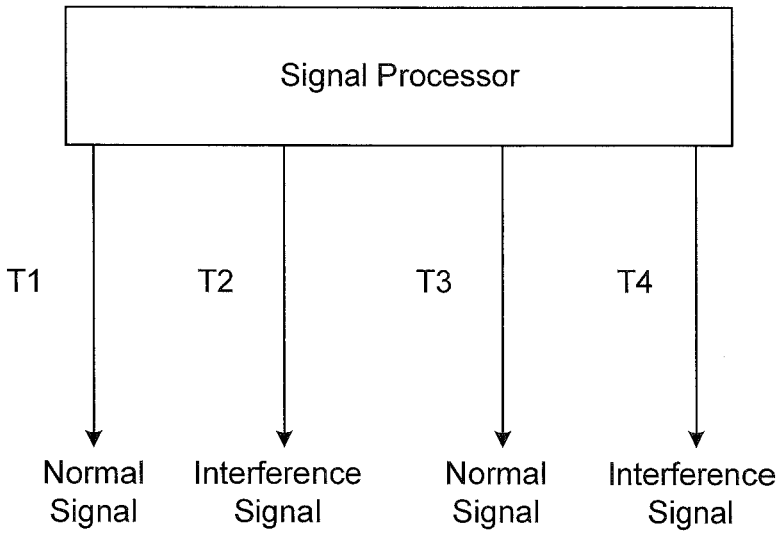
FIG. 2 is a schematic diagram I showing a process of providing a normal signal and an interference signal by a signal processor according to an embodiment of the present disclosure.

As an example, as shown in FIG. 2, when the period of time is time for a frame of image and the contiguous period of time is time for a frame of image also, the mixed image observed by the person who does not wear the shutter eyeglass is a monochromatic image. The mixed image may be white, black, blue, etc. It should be noted that because the normal image displayed for the period of time and the interference image displayed for the contiguous period of time are overlapped to form a monochromatic mixed image, the interference signal is a complementary color signal for the normal signal. In other words, when the interference signal is controlled to be the complementary color signal of the normal signal, the normal image and the interference image may be mixed to form a monochromatic mixed image. Therefore, the normal image and the interference image should correspond to each other one-to-one. For example, the signal processor 3 inputs a normal signal at time T1, and the display device 1 displays a normal image at T1; the signal processor 3 inputs an interference signal at time T2, and the display device 1 displays an interference image at T2; the signal processor 3 inputs a normal signal at time T3, and the display device 1 displays a normal image at T3; and the signal processor 3 inputs an interference signal at time T4, and the display device 1 displays an interference image at T4. The normal image displayed by the display device 1 at time T1 and the interference image displayed at time T2 are overlapped to form one monochromatic image, and the normal image displayed at time T3 and the interference image displayed at time T4 are overlapped to form one monochromatic image. Further, the interference image displayed at time T2 and the normal image displayed at time T3 are required to be overlapped to form one monochromatic image. The signal provided at time T2 is the complementary color signal of the normal signal provided at time T1. If the normal image displayed at time T1 is different from the normal image displayed at time T3, then the interference image displayed at T2 and the normal image displayed at time T3 cannot be overlapped to form a monochromatic image, and a good effect of anti-peeping cannot be achieved. In order to ensure that the interference image may be overlapped with its one-to-one corresponding normal image to form a monochromatic image, in a preferred embodiment of the present disclosure, a black image is provided between two mixed images. For example, after the time T2 and before the time T3, the signal processor 3 provides a signal to the display device 1 such that the display device 1 displays a black image.

Figure 3:
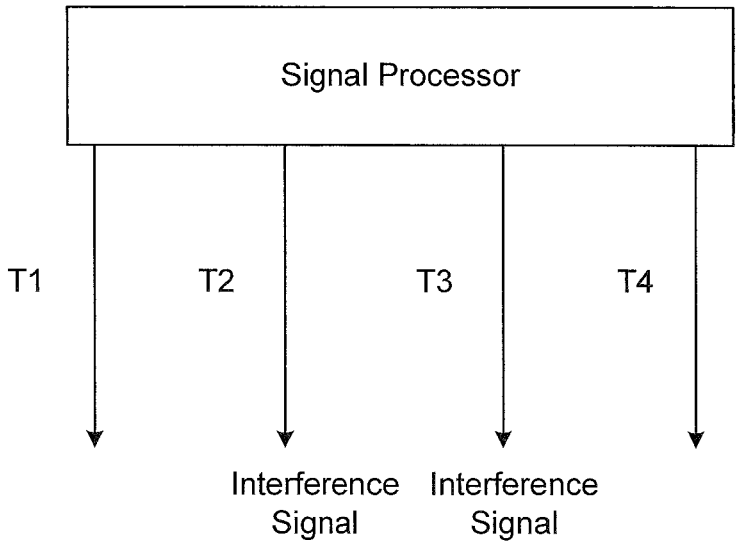
FIG. 3 is a schematic diagram II showing a process of providing a normal signal and an interference signal by a signal processor according to an embodiment of the present disclosure.

As an example, when the period of time is time for a frame of image and the contiguous period of time is time for at least one frame of image, the mixed image displayed by the display device 1 is a garbled image. The garbled image appears as mosaic or a chess board. In order to achieve the anti-peeping effect better, in a preferred embodiment of the present disclosure, the period of time is time for a frame of image and the contiguous period of time is time for at least two frames of image, such that the duration of displaying the interference image is longer than the duration of displaying the normal image, to enable the interference image overlaps the normal image completely. In this way, the normal image cannot be recognized at all without wearing the shutter glasses. As an example, as shown in FIG. 3, for example, the signal processor 3 inputs a normal signal at time T1, and the display device 1 displays a normal image at T1; the signal processor 3 inputs an interference signal at time T2, and the display device 1 displays an interference image at T2; the signal processor 3 still inputs an interference signal at time T3, and the display device 1 displays an interference image at T3; and the signal processor 3 inputs a normal signal at time T4, and the display device 1 displays a normal image at T4. In this case, the normal image displayed by the display device 1 at time T1 is separated from the normal image displayed by the display device 1 at time T4 by two interference images displayed by the display device at time T2 and time T3. In this way, a better effect of anti-peeping may be achieved. For example, the display device may display a black image at time T3.

Further, the signal processor 3 may comprise a mode indication signal reception module, a signal input module, and a signal processing module. The mode indication signal reception module receives a signal indicating the display mode from the display mode switch. The signal input module inputs the signal to be displayed. The signal processing module processes the signal input by the signal input module to acquire the signal to be provided to the display device 1. In particular, the signal processing module may comprise an interference signal generation unit configured to generate the interference signal, and a sequence control unit configured to control the sequence of the normal signal and the interference signal. When the mode indication signal reception module receives a signal indicating the normal display mode, the signal processing module processes the normal signal input by the signal input module to provide the processed signal to the display device 1. When the mode indication signal reception module receives a signal indicating the anti-peeping display mode, the interference signal generation unit generates the interference signal, and the sequence control unit controls the sequence of the normal signal input by the signal input module and the interference signal generated by the interference signal generation unit, so as to provide the signals to the display device 1.

It should be noted that when the display device 1 is in the anti-peeping display mode, the signal processor 3 provides the normal signal and the interference signal alternately to guarantee the effect of anti-peeping. In a preferred embodiment of the present disclosure, the refresh rate for the image of the display device 1 is greater than or equal to 120 Hz. In other words, the display device displays 120 images or more per second. The above images comprise normal images and interference images. The specific value of the refresh rate of the images may be adjusted based on the durations of the normal images and the interference images. As an example, when both of the durations of the normal image and the interference image are time for a frame of image, the minimal image refresh rate for the display device 1 is 120 Hz; when the duration of the normal image is time for a frame of image and the duration of the interference image is time for two frames of image, the minimal image refresh rate for the display device 1 is 180 Hz.

Figure 4:
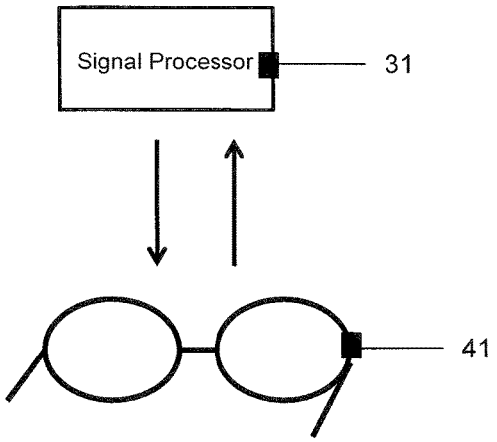
FIG. 4 is a schematic diagram showing the correspondence relations between a signal processor and a shutter eyeglass according to an embodiment of the present disclosure.

Further, in order to achieve the one-to-one correspondence between the display system and the shutter eyeglass 4 to improve the anti-peeping performance of the display system, as shown in FIG. 4, in a preferred embodiment of the present disclosure, the signal processor 3 comprises an infrared transmission module 31, the shutter eyeglass 4 comprises an infrared reception module 41, and the ID of the infrared transmission module 31 corresponds to the ID of the infrared reception module 41 in a one-to-one manner. To be specific, the infrared transmission module 31 transmits an infrared signal carrying the ID information of the infrared transmission module 31. The infrared reception module 41 receives the infrared signal and confirms whether the ID information carried by the received infrared information is the ID information of the infrared transmission module 31. If yes, the infrared reception module 41 responds with a feedback carrying the ID information of the infrared reception module 41. The infrared transmission module 31 receives the feedback and confirms whether the ID information carried by the feedback is the ID information of the infrared reception module 41. If yes, the infrared transmission module 31 and the infrared reception module 41 are paired successfully. If the ID information carried by the received infrared information is not the ID information of the infrared transmission module, or if the ID information carried by the feedback is not the ID information of the infrared reception module 41, the shutter eyeglass 4 is disabled. For example, the shutter eyeglass 4 remains in a closed state. In this way, shutter eyeglasses for other systems can be prevented from being used by someone else to peep at this system.

At this time, the signal processor 3 may further comprise a frequency synchronization control unit. When the display device 1 is in the anti-peeping display mode, and the infrared transmission module 31 and the infrared reception module 41 are paired successfully, the frequency synchronization control unit causes the switching frequencies of the normal signal and the interference signal provided by the signal processor 3 to be consistent with the frequency of switching of the shutter eyeglass 4. During the process of providing the normal signal by the signal processor 3, the shutter eyeglass 4 is in the open state. During the process of providing the interference signal by the signal processor 3, the shutter eyeglass 4 is in the closed state.

Figure 5:
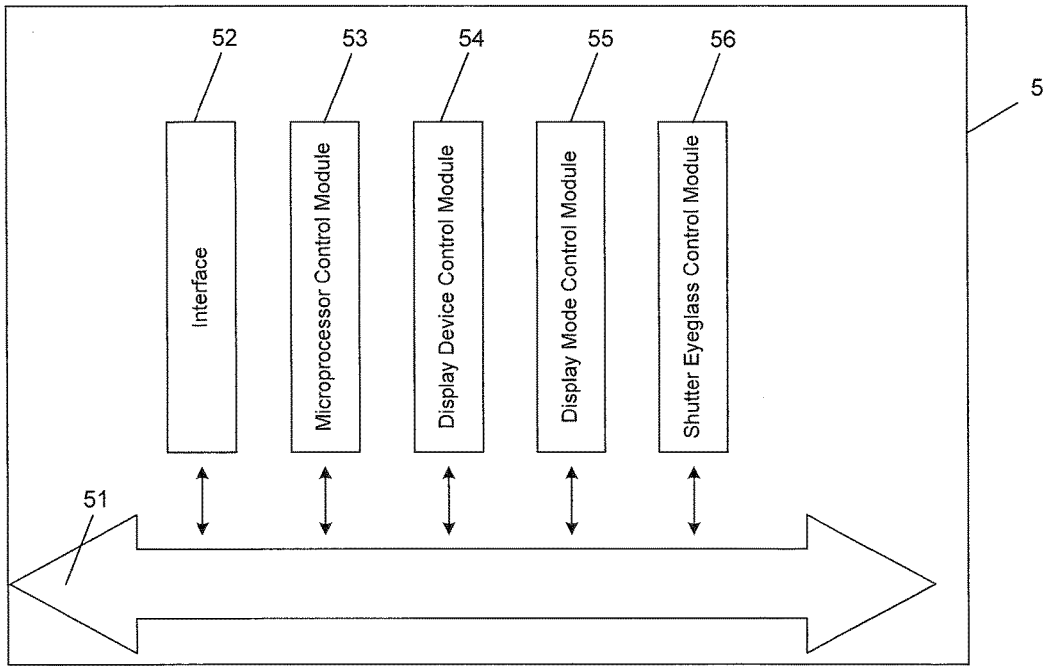
FIG. 5 is a schematic diagram showing an integrated circuit according to an embodiment of the present disclosure.

Further, the above display system further comprises an integrated circuit. To be specific, as shown in FIG. 5, the integrated circuit 5 comprises a data bus 51 and an interface 52, a microprocessor control module 53, a display device control module 54, a display mode control module 55, and a shutter eyeglass control module 56 which are interconnected via the data bus 51.

The interface 52 is configured to connect the display system to other systems or devices. The microprocessor control module 53 is configured to communicate with the display device control module 54 via the data bus 51 to enable the display system to achieve the display function. As an example, the microprocessor control module 53 comprises a CPU, a storage unit, and a system control unit. The display device control module 54 is configured to control the display device. As an example, the display device control module 54 comprises a display panel control unit, a touch screen control unit, and a backlight module control unit, etc. The display mode control module 55 is configured to control the display mode switch 2 to achieve switching of the display modes of the display device 1. The shutter eyeglass control module 56 is configured to control the movement of the shutter eyeglass 4 to achieve the ejection or restoration of the shutter eyeglass 4.

Figure 6:
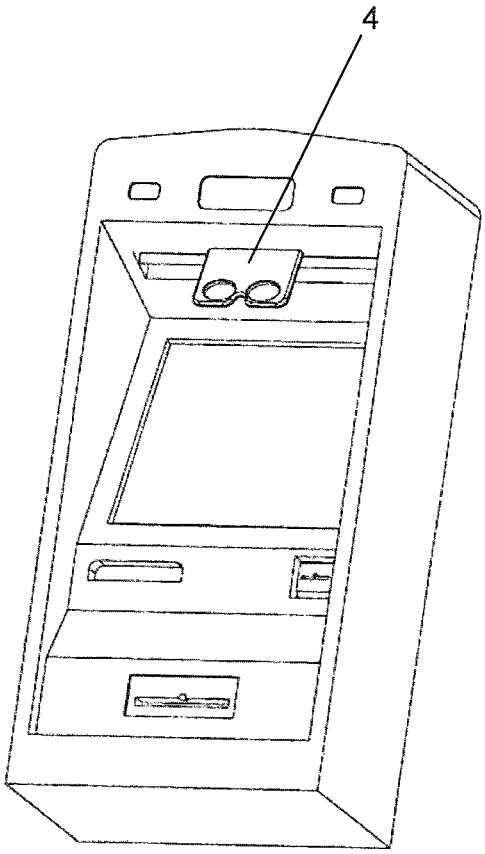
FIG. 6 is a schematic diagram I showing a shutter eyeglass of an Automated Teller Machine (ATM) after ejection according to an embodiment of the present disclosure.
Figure 7:
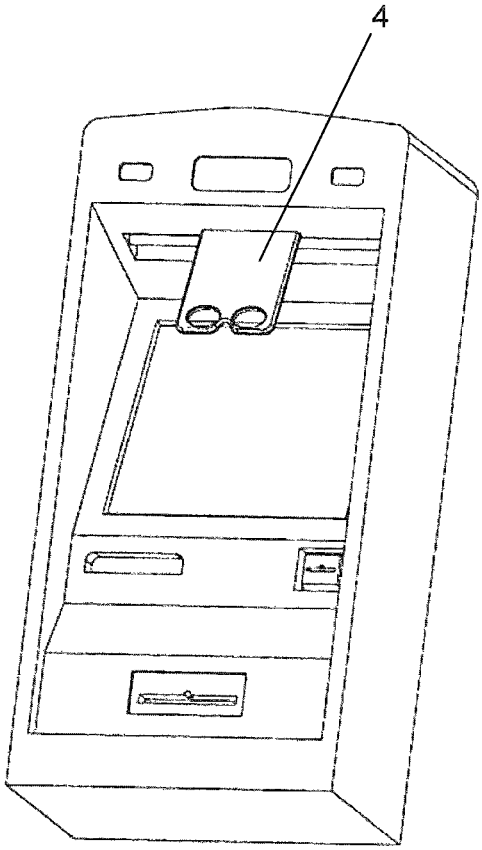
FIG. 7 is a schematic diagram II showing a shutter eyeglass of an ATM after ejection according to an embodiment of the present disclosure.
Figure 8:
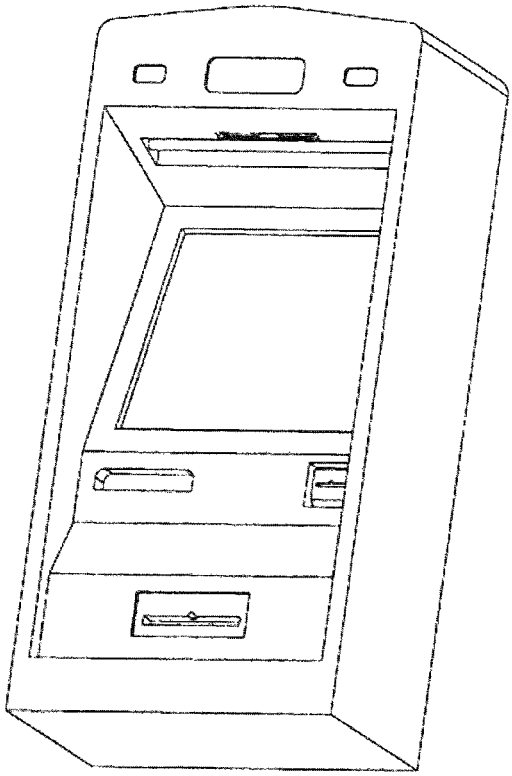
FIG. 8 is a schematic diagram showing a shutter eyeglass of an ATM after restoration according to an embodiment of the present disclosure.

To facilitate one skilled in the art in understanding, an embodiment of the present disclosure further provides a specific display system. As shown in FIGS. 6, 7, and 8, this display system may be an ATM. The shutter eyeglass 4 may be disposed in a corresponding groove of the ATM in a movably connected manner. When the ATM is in the normal display mode, as shown in FIG. 8, the shutter eyeglass 4 is located in the groove. When the ATM is in the anti-peeping mode, the shutter eyeglass 4 is enabled and ejected from the groove. The direction of the ejection may be from top to bottom, from bottom to top, from left to right, or from right to left. The present disclosure is not limited thereto. In a preferred embodiment, the direction is from top to bottom. Further, after the shutter eyeglass 4 is ejected, the operator may adjust the position of the shutter eyeglass 4 based his/her own requirements to facilitate the operator in viewing. For example, a taller operator may locate the shutter eyeglass 4 at a position shown in FIG. 6, and a shorter operator may locate the shutter eyeglass 4 at a position shown in FIG. 7. The presence of the groove facilitates the storage and safety of the eyeglasses, prevents the eyeglasses from lost or damaged. Further, the operator is not required to wear the ejected eyeglasses on his/her head, and this is convenient and comfortable.

A detailed description of the use of the ATM will be given below.

Figure 9:
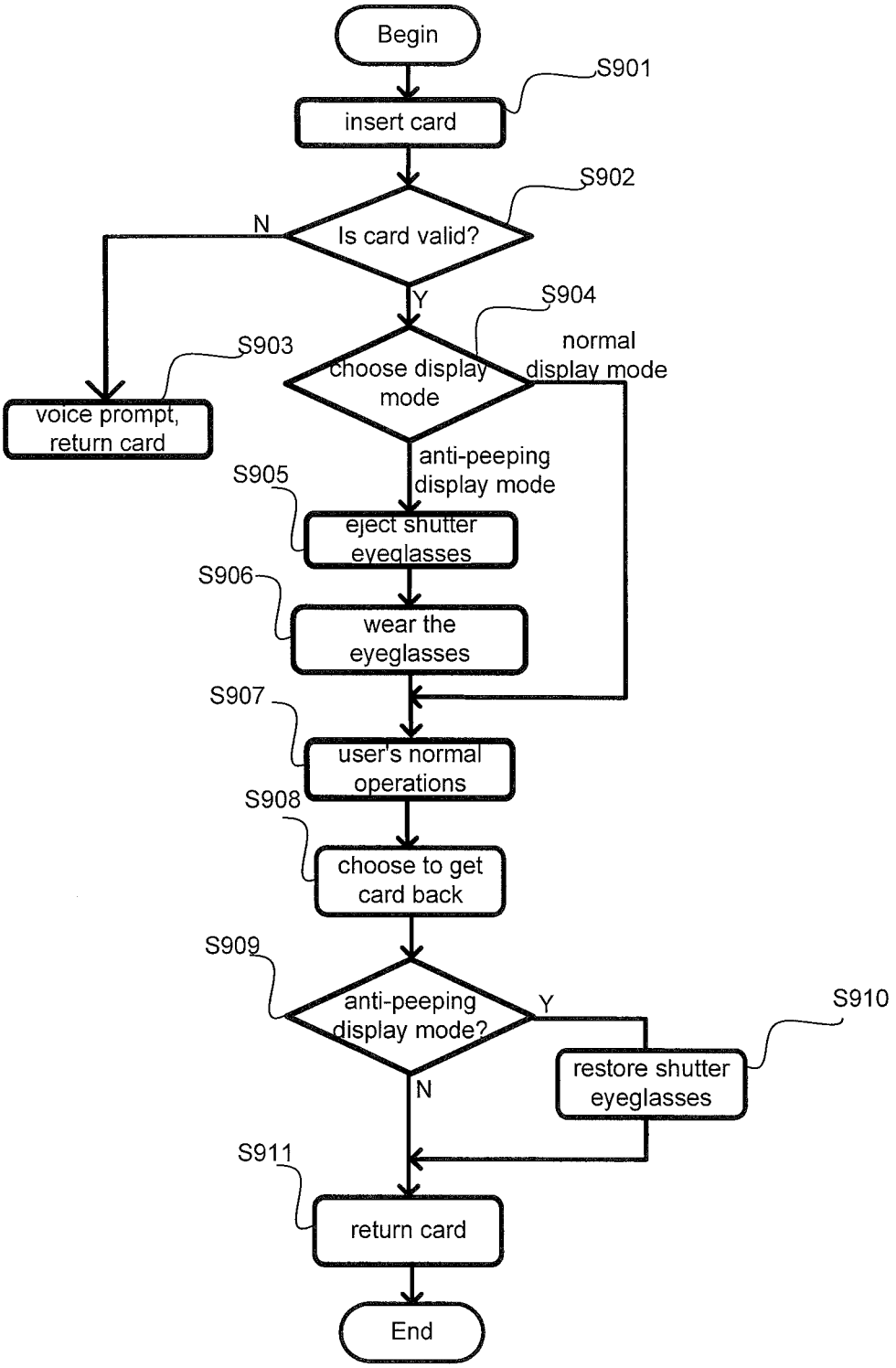
FIG. 9 is a flow chart showing a process of using an ATM according to an embodiment of the present disclosure.

During the use of the ATM, the ATM is in the normal display state when nobody is using the ATM, and the operator may determine whether the ATM malfunctions or not without wearing the shutter eyeglasses. If not, then the operation may proceed. To be specific, as shown in FIG. 9, when there is no malfunction in the ATM, the operator begins his/her operations. First, at step S901, a card inserting operation is performed. After the card is inserted by the operator, the ATM will verify the validity of the card at step S902. If the card is invalid, then the operator is prompted by a sound and the card is returned at the same time at step S903. If the card is valid, then the ATM prompts the operator to choose the display mode at step S904. The display modes comprise a normal display mode and an anti-peeping display mode. If the operator chooses the anti-peeping display mode, at step S905, the ATM displays the normal image and the interference image alternately while the shutter eyeglasses 4 are ejected. The operator may observe the normal image displayed by the ATM by wearing the shutter eyeglasses 4 at step S906, and then the operator performs his/her normal operations. If the normal display mode is chosen by the operator at step S904, then the shutter eyeglasses 4 are not ejected, and the method proceeds to step S907 at which the operator performs his/her normal operations. After the operation is completed, the operator chooses to get his/her card back at step S908. At step S909, it is determined whether the ATM is in the anti-peeping display mode. If yes, the shutter eyeglasses 4 are restored automatically at step S910, and the card is returned by the ATM at step S911 where the whole process ends. If it is determined that the ATM is in the normal display mode at step S909, then the method proceeds to step S911 where the card is returned by the ATM and the whole process ends.

It should be noted that the operator may use the physical keypad on the ATM to perform operations, such as, password input when the ATM is in the normal display mode. When the ATM is in the anti-peeping display mode, and a touch screen is disposed on the ATM, the operator may use a random keypad displayed by the ATM on the touch screen to perform operations, such as, password input. This provides a higher security.

The above description is merely related to specific implementations of the present disclosure, and the scope of the present disclosure is not limited thereto. All changes or substitutions that can be easily contemplated by one skilled in the art in view of the present disclosure shall fall into the scope of the present disclosure. Therefore, the scope of the present disclosure shall be defined by following claims.

We claim:

1. A display system, comprising a display device which comprises a display panel for displaying content, the display system further comprising:

a display mode switch configured to switch between display modes of the display device, the display modes comprising a normal display mode and an anti-peeping display mode;

a signal processor configured to provide signals to the display device, wherein the signal processor provide a normal signal to the display device when the display device is in the normal display mode, the signal processor provide the normal signal and an interference signal alternately to the display device when the display device is in the anti-peeping display mode, and the signal processor refrains from providing the interference signal to the display device in the normal display mode; and a shutter eyeglass configured to be enabled when the display device is in the anti-peeping display mode, wherein the shutter eyeglass is in an open state when the signal processor provides the normal signal, and the shutter eyeglass is in a closed state when the signal processor provides the interference signal, wherein the signal processor causes the display device to display a black image after providing an interference signal to the display device and before providing a normal signal to the display device in the anti-peeping display mode; the black image is different from the interference signal.

2. The display system according to claim 1, wherein the image displayed by the display device when the signal processor provides the normal signal is a normal image, and the image displayed by the display device when the signal processor provides the interference signal is an interference image, when the display device is in the anti-peeping display mode, the normal signal and the interference signal which are provided alternately will result in a mixed image perceived by a person without wearing the shutter eyeglass, the mixed image being formed by overlapping the interference image displayed for a period of time and the normal image displayed for a contiguous period of time.

3. The display system according to claim 2, wherein the period of time is time for a frame of image, the contiguous period of time is also time for a frame of image.

4. The display system according to claim 3, wherein the mixed image is a monochromatic image.

5. The display system according to claim 2, wherein the period of time is time for a frame of image, the contiguous period of time is time for at least one frame of image, and the mixed image is a garbled image.

6. The display system according to claim 5, wherein the garbled image appears as mosaic or a chessboard.

7. The display system according to claim 5, wherein the period of time is time for a frame of image, and the contiguous period of time is time for at least two frames of image.

8. The display system according to claim 1, wherein the signal processor comprises an infrared transmission module, the shutter eyeglass comprises an infrared reception module, and identity (ID) of the infrared reception module corresponds to the ID of the infrared transmission module in a one-to-one manner.

9. The display system according to claim 8, wherein the infrared transmission module transmits an infrared signal which carries the ID information of the infrared transmission module;

the infrared reception module receives the infrared signal, and confirms whether the ID information which is carried by the received infrared signal is the ID information of the infrared transmission module or not;

if yes, then the infrared reception module responds with a feedback which carries the ID information of the infrared reception module;

the infrared transmission module receives the feedback, and confirms whether the ID information which is carried by the feedback is the ID information of the infrared reception module or not; and if yes, then the infrared transmission module and the infrared reception module are paired successfully.

10. The display system according to claim 9, wherein the single processor comprises a frequency synchronization unit configured to make the switching frequencies of the normal signal and the interference signal provided by the signal processor to be consistent with the switching frequency of the shutter eyeglasses when the infrared transmission module and the infrared reception module are paired successfully in the case where the display device is in the anti-peeping display mode.

11. The display system according to claim 9, wherein the shutter eyeglasses remains in a closed state if the infrared transmission module and the infrared reception module are not paired successfully.

12. The display system according to claim 1, wherein the shutter eyeglass comprises two pieces of lenses or one piece of lens.

13. The display system according to claim 1, wherein the display device further comprises a shutter eyeglass accommodation structure and the shutter eyeglass is movably connected to the shutter eyeglass accommodation structure.

14. The display system according to claim 13, wherein when the display device is switched to the anti-peeping display state, the shutter eyeglass is ejected from the shutter eyeglass accommodation structure in a direction selected from the group comprised of: from top to bottom, from bottom to top, from left to right, or from right to left.

15. The display system according to claim 14, wherein the shutter eyeglass is ejected from the shutter eyeglass accommodation structure in a direction from top to bottom.

16. The display system according to claim 1, wherein the display device further comprises a touch screen to receive user input.

17. The display system according to claim 1, wherein the display mode switch comprises a display mode switch button disposed on the display device.

18. The display system according to claim 1, further comprising an integrated circuit which comprises a data bus and an interface, a microprocessor control module, a display device control module, a display mode control module, and a shutter eyeglass control module which are interconnected via the data bus, wherein the interface is configured to connect the display system to other systems or devices;

wherein the microprocessor control module is configured to communicate with the display device control module via the data bus to enable the display system to achieve the display function;

wherein the display device control module is configured to control the display device;

wherein the display mode control module is configured to control the display mode switch; and wherein the shutter eyeglass control module is configured to control the movement of the shutter eyeglass.

19. The display system according to claim 1, wherein the display device is an Automated Teller Machine (ATM).

* * * * *